US006102658A

United States Patent [19]

Kvasnak et al.

[11] Patent Number: 6,102,658

[45] Date of Patent: Aug. 15, 2000

[54] TRAILING EDGE COOLING APPARATUS FOR A GAS TURBINE AIRFOIL

[75] Inventors: William S. Kvasnak, Palm Beach Gardens, Fla.; Ronald S. LaFleur, Pottsdam, N.Y.

[73] Assignee: United Technologies Corporation, Hartford, Conn.

[21] Appl. No.: 09/218,392

[22] Filed: Dec. 22, 1998

[51] Int. Cl.[7] ..... F01D 5/18

[52] U.S. Cl. ..... 416/97 R; 416/97 A

[58] Field of Search ..... 416/97 R, 96 R, 416/97 A, 96 A; 415/115

[56] References Cited

U.S. PATENT DOCUMENTS

| | | | |
|---|---|---|---|
| 3,560,107 | 2/1971 | Helms | 416/90 R |
| 4,025,226 | 5/1977 | Hovan | 415/115 |
| 4,153,386 | 5/1979 | Leogrande | 415/115 |
| 5,342,172 | 8/1994 | Coudray et al. | 416/97 R |
| 5,403,159 | 4/1995 | Green et al. | 416/97 R |
| 5,486,093 | 1/1996 | Auxier et al. | 416/97 R |
| 5,498,133 | 3/1996 | Lee | 416/97 R |

FOREIGN PATENT DOCUMENTS

| | | | |
|---|---|---|---|
| 1007303 | 5/1952 | France | 416/97 R |
| 0108822 | 4/1990 | Japan | 416/97 R |
| 406010608 | 1/1994 | Japan | 416/97 R |

OTHER PUBLICATIONS

U.S. Patent Application Serial No. 08/969,670—Soechting et al. (Our Docket No.: F–7753).

*Primary Examiner*—Edward K. Look
*Assistant Examiner*—Rhonda Barton
*Attorney, Agent, or Firm*—Richard D. Getz

[57] ABSTRACT

A coolable airfoil is provided which includes an internal cavity, an external wall, a plurality of first cooling apertures, and a plurality of second cooling apertures. The external wall includes a suction side portion and a pressure side portion. The wall portions extend chordwise between a leading edge and a trailing edge and spanwise between an inner radial surface and an outer radial surface. The first cooling apertures are disposed in the external wall adjacent the trailing edge, exiting the airfoil through the pressure side portion. The second cooling apertures are disposed in the external wall adjacent the trailing edge, exiting the airfoil through the suction side portion.

3 Claims, 1 Drawing Sheet

FIG. 1
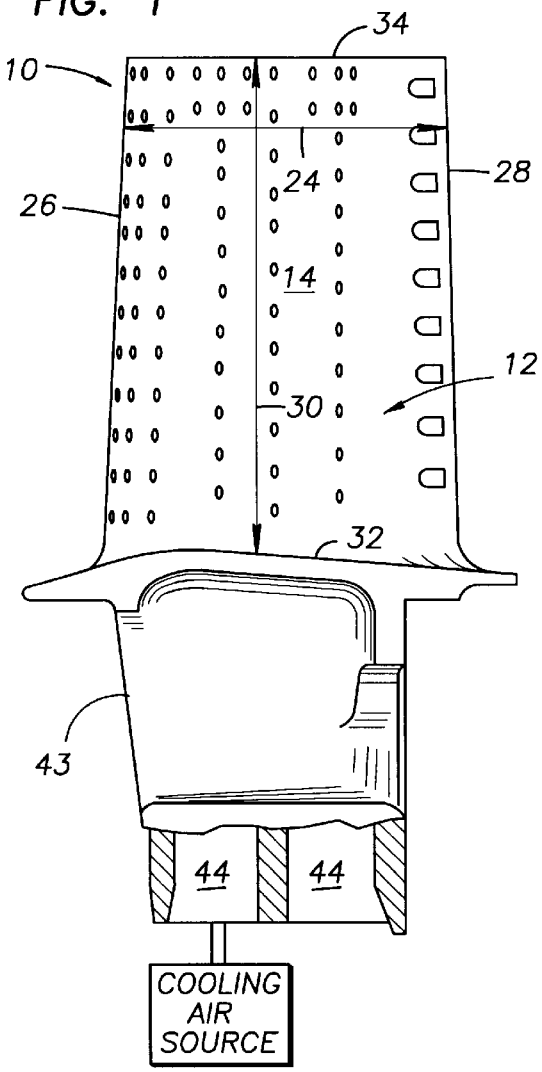
FIG. 2
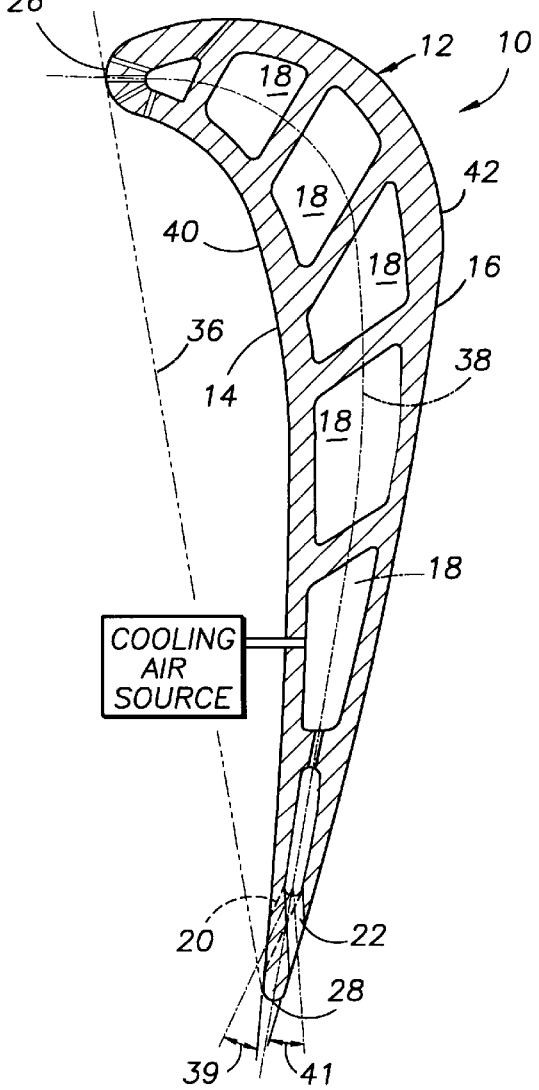
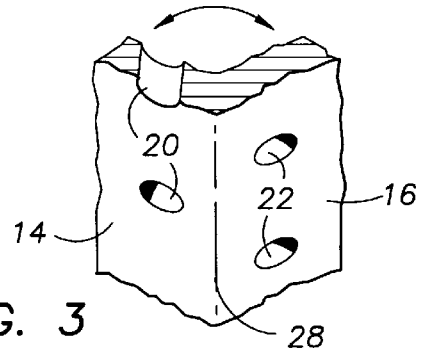
FIG. 3

TRAILING EDGE COOLING APPARATUS FOR A GAS TURBINE AIRFOIL

The Government has rights in this invention, pursuant to Contract No. F33615-95-C-2503 (5.1.1072) awarded by the Department of the Air Force.

BACKGROUND OF THE INVENTION

1. Technical Field

This invention relates to coolable airfoils in general, and to trailing edge cooling hole configurations in coolable airfoils in particular.

2. Background Information

In modern axial gas turbine engines, turbine rotor blades and stator vanes require extensive cooling. A typical rotor blade or stator vane airfoil includes a serpentine arrangement of passages connected to a cooling air source, such as the compressor: Air bled from the compressor provides a favorable cooling medium because its pressure is higher and temperature lower than the core gas traveling through the turbine; the higher pressure forces the compressor air through the passages within the component and the lower temperature transfers heat away from the component. In conventional airfoils, the cooling air exits the airfoil via cooling holes disposed, for example, along both sides of the leading edge or disposed in the pressure-side wall along the trailing edge. Cooling is particularly critical along the trailing edge, where the airfoil narrows considerably. Most airfoil designs include a line of closely packed cooling holes in the exterior surface of the pressure-side wall, distributed along the entire span of the airfoil. A relatively small pressure drop across each of the closely packed holes encourages cooling air exiting the holes to form a boundary layer of cooling air (film cooling) aft of the holes that helps cool and protect the aerodynamically desirable narrow trailing edge.

Conventional pressure-side trailing edge cooling schemes represent a trade-off between cooling flow and mechanical durability. The narrow cross-section of the airfoil at the trailing edge makes it impractical to cool the trailing edge via an internal cavity adjacent the trailing edge. In place of the cavity it is known to extend diffused cooling holes through the pressure-side of the external wall upstream of the trailing edge. The size and number of the conventional cooling holes reflects the cooling air flow necessary to cool the trailing edge. The practical size and number of the holes are limited, however, by the thickness of the airfoil wall. If the diffused apertures are positioned too close to the trailing edge, the trailing edge becomes undesirably thin and consequently susceptible to mechanical fatigue. To avoid the fatigue, the diffused holes are moved forward. Film cooling effectiveness, however, is inversely related to the distance traveled by the film.

What is needed is an airfoil with trailing edge cooling apparatus with improved cooling and one with improved resistance to mechanical fatigue.

DISCLOSURE OF THE INVENTION

It is, therefore, an object of the present invention to provide an airfoil with improved cooling along its trailing edge.

It is another object of the present invention to provide an airfoil with improved resistance to mechanical fatigue.

According to the present invention, a coolable airfoil is provided which includes an internal cavity, an external wall, a plurality of first cooling apertures, and a plurality of second cooling apertures. The external wall includes a suction side portion and a pressure side portion. The wall portions extend chordwise between a leading edge and a trailing edge and spanwise between an inner radial surface and an outer radial surface. The first cooling apertures are disposed in the external wall adjacent the trailing edge, exiting the airfoil through the pressure side portion. The second cooling apertures are disposed in the external wall adjacent the trailing edge, exiting the airfoil through the suction side portion.

An advantage of the present invention is that cooling along the trailing edge is improved. Conventional cooling schemes provide cooling holes extending through the pressure side, typically oriented to establish film cooling aft of the apertures. A problem with the conventional trailing edge film cooling is that it is least effective at the tip of the airfoil where it is most needed. In addition, the conventional cooling scheme favors the pressure-side portion over the suction-side portion, consequently leaving the suction-side portion more susceptible to thermal distress. The present invention, in contrast, provides cooling along the pressure-side and the suction-side portions of the trailing edge. As a result, the deficiencies associated with conventional trailing edge film cooling are minimized.

Another advantage of the present is that it avoids the stress risers associated with conventional trailing edge cooling schemes, and thereby minimizes the opportunity for mechanical fatigue. In conventional trailing edge cooling schemes, the cooling apertures are typically coupled with diffusers which extend aft toward the trailing edge. The diffusers decrease the amount of wall material and consequently increase the opportunity for mechanical fatigue.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic drawing of a rotor blade.

FIG. 2 is a diagrammatic sectional of an airfoil.

FIG. 3 is a diagrammatic sectional of a trailing edge, split open to better illustrate the positioning of the cooling apertures along the trailing edge.

BEST MODE FOR CARRYING OUT THE INVENTION

Referring to FIGS. 1 and 2, a hollow airfoil 10 for gas turbine engine includes an external wall 12 having a pressure-side portion 14 and a suction-side portion 16, a plurality of internal cavities 18 disposed between the pressure-side and suction-side wall portions 14,16, a plurality of first cooling apertures 20, and a plurality of second cooling apertures 22. The internal cavities 18 are connected to a source of cooling air such as the compressor (not shown). The pressure-side wall portion 14 and the suction-side wall portion 16 extend widthwise 24 between a leading edge 26 and a trailing edge 28, and spanwise 30 between an inner radial platform 32 and an outer radial surface 34. In the case of a rotor blade, the outer radial surface of the airfoil 10 is the blade tip. In the case of a stator vane, the outer radial surface is an outer platform (not shown). The airfoil 10 may be described in terms of a chordline 36 and a mean camber line 38. The chordline 36 extends between the leading edge 26 and the trailing edge 28. The camber line 38 extends between the leading edge 26 and the trailing edge 28 along a path equidistant between the outer surface 40 of the pressure-side wall portion 14 and the outer surface 42 of the suction-side wall portion 16. If the airfoil 10 is symmetrical about the chordline 36, the chordline 36 and the mean camber line 38 coincide. If the airfoil 10 is unsymmetrical about the chordline 36 (i.e., "cambered"), the mean camber line 38 intersects the chordline 36 at the leading edge 26 and trailing edge 28, and deviates therebetween. The exemplary airfoil 10 shown in FIG. 1 is a part of a rotor blade having a root 43 with cooling air inlets 44. An airfoil as part of a stator vane may also embody the present invention. FIG. 2 shows a cross-section of an airfoil 10 (part of a stator vane or rotor blade) embodying the present invention, having a plurality of internal cavities 18, connected to one another in a serpentine manner.

Referring to FIG. 2, the plurality of first cooling apertures 20 extend through and exit the pressure-side wall portion 14 of the external wall 12 adjacent the trailing edge 28. The plurality of second cooling apertures 22 extend through and exit the suction-side wall portion 16 of the external wall 12 adjacent the trailing edge 28. The geometry of the first and second cooling apertures 20,22 will vary depending upon the cooling needs of the application at hand. In some applications, for example, it may be useful to have diffused first and second cooling apertures 20,22. The angles 39,41 between the surfaces 40,42 of the airfoil external wall 12 and the cooling apertures 20,22 are selected to provide optimal cooling and can be varied to suit the application at hand.

Referring to FIGS. 2 and 3, in the preferred embodiment the first and second cooling apertures 20,22 are disposed alternately along the trailing edge 28 span of the airfoil 10. Alternating the cooling apertures 20,22 between the suction-side wall portion 16 and the pressure-side wall portion 14 increases the amount of wall material between adjacent cooling apertures 20,22. In some applications, however, it may be useful to tailor the positioning of the first and second cooling apertures 20,22 along the trailing edge 28. For example, if there is a particular region along the suction-side wall portion 16 adjacent the trailing edge 28 that experiences a significantly greater thermal load than the coinciding pressure-side wall portion 14, a number of second cooling apertures 22 can be disposed in the suction-side wall portion 16 to offset the thermal load. The thermal load of any application can be determined empirically or analytically and the first and second cooling apertures 20,22 positioned accordingly.

In the operation of a cambered airfoil 10 (as shown in FIG. 2), core gas traveling along the suction-side wall portion 16 travels at a faster velocity than core gas traveling along the pressure-side wall portion 14. The difference in velocity creates a difference in pressure across the airfoil 10 that causes the airfoil 10 to experience lift. The difference in pressure also affects the cooling air exiting the first and second cooling apertures 20,22. Assuming the cooling apertures 20,22 have equal cross-sectional areas, the lower pressure along the suction-side wall portion 16 will cause the cooling air exiting the second cooling apertures 22 to exit at a faster velocity than cooling air exiting the first cooling apertures 20.

Although this invention has been shown and described with respect to the detailed embodiments thereof, it will be understood by those skilled in the art that various changes in form and detail thereof may be made without departing from the spirit and the scope of the invention.

We claim:

1. A coolable airfoil comprising:

an internal cavity;

an external wall, which includes a suction side portion and a pressure side portion, wherein said portions extend chordwise between a leading edge and a trailing edge and spanwise between an inner radial surface and an outer radial surface;

a plurality of first cooling apertures, disposed in said external wall adjacent said trailing edge, extending through said pressure side portion; and a plurality of second cooling apertures, disposed in said external wall adjacent said trailing edge, extending through said suction side portion;

wherein cooling air entering said internal cavity exits said airfoil through said first and second cooling apertures;

wherein said first and second cooling apertures are disposed alternately along said trailing edge.

2. A coolable airfoil according to claim 1, wherein said first and second cooling apertures are substantially equidistant from said trailing edge.

3. A coolable airfoil according to claim 2, wherein said first and second apertures have substantially equal cross-sectional areas.

* * * * *